United States Patent [19]

Straesser

[11] 4,100,664

[45] Jul. 18, 1978

[54] APEX SEAL FOR ROTARY ENGINES

[75] Inventor: Chris Robert Straesser, East Peoria, Ill.

[73] Assignee: Caterpillar Tractor Co., Peoria, Ill.

[21] Appl. No.: 615,779

[22] Filed: Sep. 22, 1975

Related U.S. Application Data

[62] Division of Ser. No. 541,810, Jan. 17, 1975, abandoned.

[51] Int. Cl.[2] ..... B23P 15/06

[52] U.S. Cl. ..... 29/156.6; 29/420.5; 418/178; 418/179; 75/208 R; 428/547

[58] Field of Search ..... 29/156.6, 156.63, 420.5, 29/423; 418/178, 179, 113–124; 75/208 R; 428/547

[56] References Cited

U.S. PATENT DOCUMENTS

| | | | |
|---|---|---|---|
| 2,161,597 | 6/1939 | Swartz | 75/208 R |
| 2,167,544 | 7/1939 | De Bats et al. | 29/420.5 |
| 2,464,517 | 3/1949 | Kurtz | 29/420.5 |
| 2,549,939 | 4/1951 | Shaw et al. | 29/420.5 |
| 3,010,196 | 11/1961 | Smith et al. | 29/420.5 |
| 3,561,087 | 2/1971 | Koehler | 29/156.6 |
| 3,658,451 | 4/1972 | Gomada | 418/178 |
| 3,672,798 | 6/1972 | Scherenberg | 418/113 |
| 3,830,601 | 8/1974 | Yamazaki | 418/113 |
| 3,947,161 | 3/1976 | McLain | 418/178 |

FOREIGN PATENT DOCUMENTS

| | | | |
|---|---|---|---|
| 1,159,224 | 12/1963 | Fed. Rep. of Germany | 277/26 |
| 696,715 | 9/1953 | United Kingdom | 29/420.5 |

*Primary Examiner*—C.W. Lanham
*Assistant Examiner*—Daniel C. Crane
*Attorney, Agent, or Firm*—Wegner, Stellman, McCord, Wiles & Wood

[57] ABSTRACT

An improved seal for a rotary engine to reduce leakage at the rotor apex under normal operating temperatures. Opposite edges of the seal have differing coefficients of thermal expansion so that as the seal heats up, thermal expansion forces cancel the effect of non-uniform temperature across the seal to insure flush contact with the housing wall.

1 Claim, 3 Drawing Figures

Fig. 1
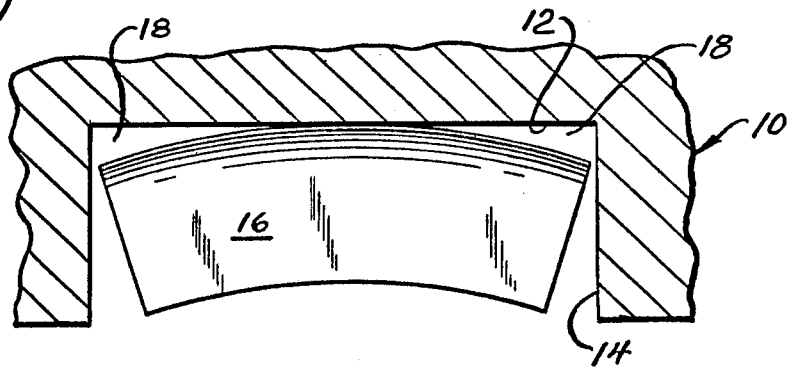
PRIOR ART - HOT
Fig. 2
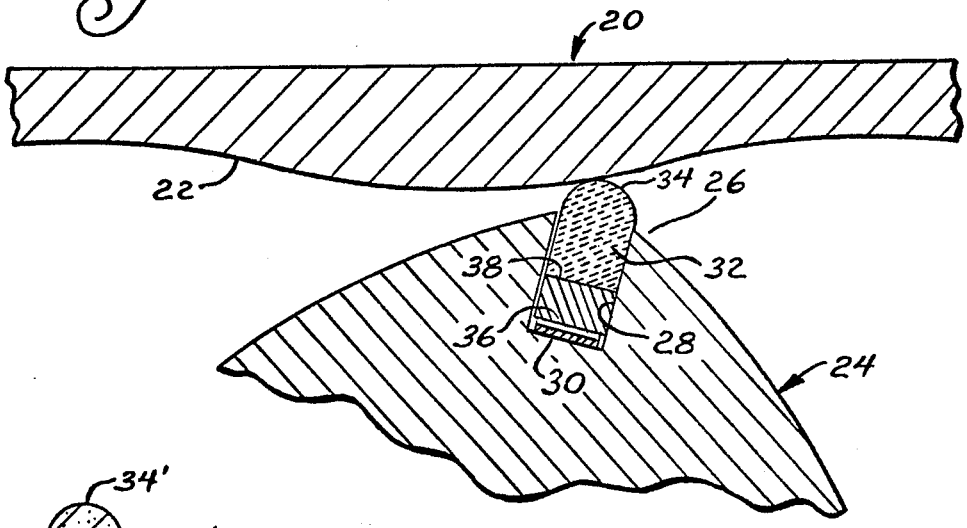
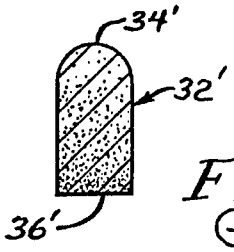
Fig. 3

APEX SEAL FOR ROTARY ENGINES

This is a division, of application Ser. No. 541,810 filed Jan. 17, 1975, now abandoned.

BACKGROUND OF THE INVENTION

This invention relates to rotary engines and, more specifically, to improved apex seals for rotary engines.

Prior art of possible relevance includes U.S. Pat. Nos. 3,113,526 to Paschke; 3,197,125 to Bachman et al; 3,300,124 to Jones; 3,658,451 to Gomada; 3,672,798 to Scherenberg; and 3,785,745 to Lamm.

Even though the operating and basic construction principles of rotary engines such as the so-called "Wankel" have been known for many years, the same have not been commercialized to any appreciable extent principally due to difficulties in solving seal problems. Consequently, there is a real need for more reliable seals, such as apex seals, in rotary engines.

One particular difficulty encountered with apex seals is their tendency to bow in a concave fashion looking radially outwardly of the rotor when under load. Consequently, leakage spaces form at the edges of the seal.

There have been various proposals to solve this difficulty such as the use of side-by-side sealing elements provided with grooves such as shown by Paschke in his previously identified patent. However, such constructions tend to be prone to sticking, resulting in seal failure and/or inability to flex to close leakage openings around the seals.

SUMMARY OF THE INVENTION

It is the principal object of the invention to provide a new and improved seal for rotary engines. More specifically, it is an object to provide such a seal whereby the tendency of the same to bow under load is minimized.

The exemplary embodiment of the invention achieves the foregoing object in a seal wherein the radially outer edge with respect to the rotor is formed of a material having a first coefficient of thermal expansion while the opposite edge, typically received within a rotor groove, is formed of a material having a second and higher coefficient of thermal expansion. Consequently, as the seal heats up as the engine approaches normal operating tendencies, the lower edge of the seal will expand at a rate greater than the rate of expansion of the upper edge so that expansion at each edge is the same to compensate for the tendency to bow. As a result, at normal operating temperatures, the seal remains straight.

According to one embodiment of the invention, the seal may be formed of various materials sintered together in such a way as to have a gradient in the coefficient of thermal expansion across the seal from one edge to the other while according to a second embodiment of the invention, two elongated elements, each having different coefficients of thermal expansion, are bonded together.

Other objects and advantages will become apparent from the following specification taken in conjunction with the accompanying drawings.

DESCRIPTION OF THE DRAWINGS

FIG. 1 is a somewhat schematic, exaggerated view of a prior art seal at normal operating temperatures;

FIG. 2 is a fragmentary, somewhat schematic, sectional view of a rotary engine embodying a seal made according to the invention; and FIG. 3 is a cross sectional view of a modified embodiment of a seal.

DESCRIPTION OF THE PREFERRED EMBODIMENTS

Before turning to a detailed description of applicants' invention, a typical prior art structure will be described in connection with FIG. 1. As can be seen, a rotary engine includes a housing, generally designated 10, having an end wall 12, which may be of trochoidal shape or any other shape customarily employed for rotary engines and two side walls 14. A seal 16, carried by a rotor (not shown) is intended to sealingly engage against the wall 12. However, in normal operation, as the seal 16 heats up to normal operating temperatures, it will tend to assume a convex bowed configuration such as that shown in exaggerated lform in FIG. 1. Consequently, leakage spaces 18, at opposite ends of the seal 16, will occur with the result that engine efficiency is decreased. The causes of such deformation are well known.

Turning now to FIG. 2, applicants' invention will be described. The same includes a rotary engine having a housing, generally designated 20, with an interior wall 22 corresponding to the interior wall 12. A rotor, generally designated 24, is located within the housing and is associated with a shaft in conventional fashion. The rotor 24 has a plurality of apices 26 (only one of which is shown) and each apex 26 is provided with a seal receiving groove 28. Within the groove 28 is a biasing spring 30 for biasing a seal 32 outwardly into sealing engagement with the wall 22.

According to the invention, the seal 32 has its edge 34 in sealing engagement with the wall 22 formed of a material having a first coefficient of thermal expansion. The opposite edge 36 is formed of a different material having a second coefficient of thermal expansion which is higher than the first coefficient of thermal expansion.

As is well known, the edge 34 will normally be at a higher operating temperature than the edge 36 by reason of the latter being cooled somewhat by the rotor 24 and not having as direct an exposure to the hot gases of combustion. However, because of its higher coefficient of thermal expansion, even though at a lower temperature, its expansion will be such as to equal that of the edge 34 so that the seal 32 will remain in flush, good sealing engagement with the wall 22 at all times.

The particular coefficients of thermal expansion employed will, of course, vary, depending upon the normal intended operating temperature of the engine to which the seal 32 is subjected. Alternately seal geometry at operating temperature can be controlled by suitably varying the location and amounts of the materials employed.

In the embodiment shown in FIG. 2, the edge 34 is defined by a first member while the edge 36 is defined by a second member and the two are bonded together as at 38 by any suitable means. For example, the edge 34 may be formed of an iron member which may be brazed, silver soldered or friction welded onto the edge 36 which can be formed of high expansion grades of Ni-Resist iron or austentic stainless steels. Preferably, the member defining the edge 34 is formed of ch.

Alternately, the edge 34 may be formed of hardenable iron attached to stainless steel.

FIG. 3 illustrates an alternative embodiment of a seal, generally designated 32'. The wall engaging edge is designated 34' while the edge received within the rotor groove is designated 36'. According to the embodiment of FIG. 3, a gradient, either constant or variable, in the coefficient of thermal expansion is generated from the edge 34' to the edge 36' by varying the composition of the seal from one edge to the other. According to this embodiment, it is preferred that the seal be formed of sintered materials. It is contemplated that ceramics may be employed to principally define the edge 34' while metallic components will define the edge 36'. The two are intended to be intermixed, but in varying proportions from one edge to the other. Thus the edge 34' would be principally ceramic with very little metal while the edge 36' would be of the opposite composition. Intermediate the edges, the proportions would vary.

A seal such as that shown in FIG. 3 can be formed by centrifuging in molds where the material is in the form of small particles that tend to have flow characteristics akin to liquids. Where the ceramic is more dense than the metal employed, the mold would be such as to define the edge 34'at a radially outer position therein. Of course, if the densities were reversed, the mold would be configured oppositely from that just mentioned.

The mold employed will have a cross-section shaped approximately like that of the seal 32' and having a length somewhat greater than the desired length of the finished seal. Generally, the mold dimensions will be slightly larger than that of the finished seal as it would exist at the time of installation into the engine so that some machining for finished purposes may be employed.

One or more such molds are suitably mounted on a centrifuge and the centrifuge then energized. While the molds are rotated on the centrifuge the particles are introduced thereinto.

After particle introduction has been completed, the centrifuge may be deactivated and the mold removed. Material in the mold is then compacted and sintered. After sintering, the seal may be finish machined to its desired configuration.

An alternate method of forming the seal 32 is to form the same of several layers, the coefficients of thermal expansion of each layer differing. Each layer is separately introduced into a mold such as that described above and following the introduction of each layer, a strip of low-ash paper introduced into the mold. Thereafter, the next layer may be introduced, followed by another strip of low-ash paper. The process is repeated until the desired number of layers have been introduced into the mold.

At this time, the material in the mold may be compacted, sintered and finish machined to form the seal. It will be appreciated that during the sintering process, the paper strips will be burned out. By reason of the low-ash content of the paper, the amount of ash remaining from the paper after the sintering process will be insufficient to interfere with seal integrity and operation.

From the foregoing, it will be appreciated that seals made according to the invention eliminate the bowing problem heretofore causing appreciable leakage in rotary engines.

We claim:

1. The method of forming a seal for rotary engines having different coefficients of thermal expansion at opposite edges comprising the steps of:

(a) providing a mold having a shape corresponding approximately to the desired shape of the seal to be formed;

(b) introducing in to the mold a layer of sinterable material having a first coefficient of thermal expansion;

(c) thereafter introducing into the mold a strip of low-ash paper;

(d) repeating, seriatim, steps (b) and (c) using materials, each having different coefficients of thermal expansion until the desired number of layers, each separated by a strip of low-ash paper have been received in the mold;

(e) compacting the materials in the mold;

(f) sintering the materials; and (g) thereafter finish machining the seal to a desired final configuration with the layers of different coefficients of thermal expansion providing a different coefficient of thermal expansion from top to bottom of the seal.

* * * * *